US009052153B2

(12) United States Patent
Oh et al.

(10) Patent No.: US 9,052,153 B2
(45) Date of Patent: Jun. 9, 2015

(54) COMMUNICATION CONNECTOR SYSTEM FOR A WEAPON

(71) Applicant: Tyco Electronics Corporation, Berwyn, PA (US)

(72) Inventors: Lawrence Se-Jun Oh, Hummelstown, PA (US); Richard Vincent Lucente, Mechanicsburg, PA (US); Robert Neil Mulfinger, York Haven, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 107 days.

(21) Appl. No.: 13/653,096

(22) Filed: Oct. 16, 2012

(65) Prior Publication Data

US 2014/0130392 A1 May 15, 2014

(51) Int. Cl.

| | |
|---|---|
| ***F41C 23/04*** | (2006.01) |
| ***F41A 35/00*** | (2006.01) |
| ***F41G 11/00*** | (2006.01) |
| ***F41A 3/66*** | (2006.01) |
| ***F41C 23/22*** | (2006.01) |
| ***F41C 27/00*** | (2006.01) |

(52) U.S. Cl.

CPC ..... *F41A 35/00* (2013.01); *F41C 23/04* (2013.01); *F41G 11/003* (2013.01); *F41A 3/66* (2013.01); *F41C 23/22* (2013.01); *F41C 27/00* (2013.01)

(58) Field of Classification Search

CPC ..... F41C 27/00; F41C 23/04; F41A 3/66; F41A 23/22

USPC ..... 42/84, 75.01, 71.01

See application file for complete search history.

(56) References Cited

U.S. PATENT DOCUMENTS

| | | | | |
|---|---|---|---|---|
| 2,696,605 | A * | 12/1954 | Knickerbocker | 73/167 |
| 2,942,524 | A * | 6/1960 | Hawkins | 89/14.1 |
| 5,179,235 | A | 1/1993 | Toole | |
| 5,434,091 | A | 7/1995 | Hill et al. | |
| 5,557,872 | A | 9/1996 | Langner | |
| 5,674,585 | A | 10/1997 | Ewing et al. | |
| 5,704,153 | A | 1/1998 | Kaminski et al. | |
| 5,706,600 | A | 1/1998 | Toole et al. | |
| 6,434,875 | B1 | 8/2002 | Constant et al. | |
| 6,671,991 | B1 | 1/2004 | Danielson | |
| 7,260,910 | B2 | 8/2007 | Danielson | |
| 7,627,975 | B1 | 12/2009 | Hines | |
| 7,669,359 | B2 | 3/2010 | Kim | |

(Continued)

FOREIGN PATENT DOCUMENTS

| | | |
|---|---|---|
| WO | 9429664 | 12/1994 |
| WO | 2011085295 | 7/2011 |

*Primary Examiner* — Stephen M Johnson

(57) ABSTRACT

A communication connector system is provided for a weapon. The system includes an upper connector configured to be mounted directly to an exterior side surface of an upper receiver of the weapon. The upper connector is configured to be communicatively connected to electronics associated with the upper receiver. The upper connector has a mating interface. The system includes a lower connector configured to be communicatively connected to electronics in a base of the weapon. The lower connector is configured to be mounted directly to an exterior side surface of a lower receiver of the weapon. The lower connector has a mating interface that is mated with the mating interface of the upper connector when the upper receiver is in a closed position. The mating interfaces are physically separable from one another such that the upper receiver is configured to be moved to an open position from the closed position.

20 Claims, 6 Drawing Sheets

(56) References Cited

U.S. PATENT DOCUMENTS

| | | | | |
|---|---|---|---|---|
| 7,743,547 | B2 | 6/2010 | Houde-Walter | |
| 7,975,419 | B2 | 7/2011 | Darian | |
| 8,006,428 | B2 | 8/2011 | Moore et al. | |
| 8,091,265 | B1 | 1/2012 | Teetzel et al. | |
| 8,091,267 | B2 | 1/2012 | Moore et al. | |
| 8,104,211 | B2 | 1/2012 | Darian | |
| 2010/0083553 | A1 | 4/2010 | Montgomery | |
| 2010/0192443 | A1 | 8/2010 | Cabahug et al. | |
| 2010/0192446 | A1* | 8/2010 | Darian | 42/84 |
| 2010/0275489 | A1 | 11/2010 | Cabahug et al. | |
| 2011/0061284 | A1 | 3/2011 | Cabahug et al. | |
| 2011/0154712 | A1 | 6/2011 | Moore et al. | |
| 2011/0157388 | A1 | 6/2011 | Liu | |
| 2012/0144714 | A1* | 6/2012 | Cabahug et al. | 42/73 |
| 2012/0151814 | A1* | 6/2012 | Dietel | 42/84 |
| 2013/0047482 | A1* | 2/2013 | Mulfinger | 42/84 |

* cited by examiner

COMMUNICATION CONNECTOR SYSTEM FOR A WEAPON

BACKGROUND OF THE INVENTION

The subject matter herein relates generally to communication connector systems for weapons.

Weapons, such as AR-15s, M4's, M-16's, and others, include a rail having electronics mounted to or within the upper rail. The upper rail may include a laser, night vision scope, camera or other type of electronic that needs power. The electronics may also send or receive data. The weapons typically include electronics, including batteries, in the lower part of the weapon, such as in the butt stock, hand grip, lower receiver, which are communicatively connected to the electronics in the upper rail.

Connecting the electronics in the lower part of the weapon with the electronics in the upper rail has heretofore proven difficult. Some systems use wires along the outside of the gun that interconnect the electronics in the lower part of the weapon with the electronics in the upper rail. The wires tend to catch or snag or are exposed to be easily damaged, which is problematic. Other systems route wires internally, however the upper and lower receivers need to be completely redesigned, and thus are not compatible with existing parts. Additionally, the weapons are often disassembled, such as for cleaning, and having the internal wiring makes disassembly difficult.

BRIEF DESCRIPTION OF THE INVENTION

In one embodiment, a communication connector system is provided for a weapon. The weapon has an upper receiver with electronics associated with the upper receiver. The weapon has a base that includes a lower receiver. The base houses electronics. The upper receiver is configured to be coupled to the lower receiver in a closed position and at least partially de-coupled from the lower receiver in an open position. The communication connector system includes an upper connector configured to be mounted directly to an exterior side surface of the upper receiver of the weapon. The upper connector is configured to be communicatively connected to the electronics associated with the upper receiver. The upper connector has a mating interface. The communication connector system includes a lower connector configured to be communicatively connected to the electronics in the base of the weapon. The lower connector is configured to be mounted directly to an exterior side surface of the lower receiver of the weapon. The lower connector has a mating interface that is mated with the mating interface of the upper connector when the upper receiver is in the closed position. The mating interfaces of the upper and lower connectors are physically separable from one another such that the upper receiver is configured to be moved to the open position from the closed position.

In another embodiment, a weapon includes a base having a lower receiver. The base houses electronics therein. The lower receiver includes an exterior side surface and a channel extending into the exterior side surface. The weapon includes an upper receiver having an exterior side surface and a channel extending into the exterior side surface. The weapon includes electronics associated with the upper receiver. The upper receiver is configured to be coupled to the lower receiver in a closed position and at least partially de-coupled from the lower receiver in an open position. The weapon includes a communication connector system, which includes an upper connector mounted to the upper receiver. The upper connector has a mating interface. An upper communications conductor extends within the channel of the upper receiver. The upper communications conductor communicatively connects the upper connector to the electronics associated with the upper receiver. The communications connector system includes a lower connector mounted to the lower receiver. The lower connector has a mating interface that is mated with the mating interface of the upper connector when the upper receiver is in the closed position. A lower communications conductor extends within the channel of the lower receiver. The lower communications conductor communicatively connects the lower connector to the electronics in the base.

In another embodiment, a weapon includes a base having a lower receiver. The base houses electronics therein. The lower receiver includes a lower pin opening and a cavity. The weapon includes an upper receiver having an attachment member that includes an upper pin opening. The upper receiver has electronics associated therewith. The upper receiver is configured to be coupled to the lower receiver in a closed position and at least partially de-coupled from the lower receiver in an open position. The attachment member of the upper receiver is received within the cavity of the lower receiver when the upper receiver is in the closed position such that the upper and lower pin openings are aligned. The weapon includes a takedown pin that is configured to be received within the upper and lower pin openings to hold the upper receiver in the closed position. The weapon includes a communications connector system, which includes an upper connector mounted to attachment member of the upper receiver. The upper connector is communicatively connected to the electronics associated with the upper receiver. The upper connector has a mating interface. The communications connector system includes a lower connector held within the cavity of the lower receiver. The lower connector is communicatively connected to the electronics in the base. The lower connector has a mating interface. The mating interfaces of the upper and lower connectors are mated together within the cavity of the lower receiver when the upper receiver is in the closed position.

DETAILED DESCRIPTION OF THE INVENTION

Figure 1:
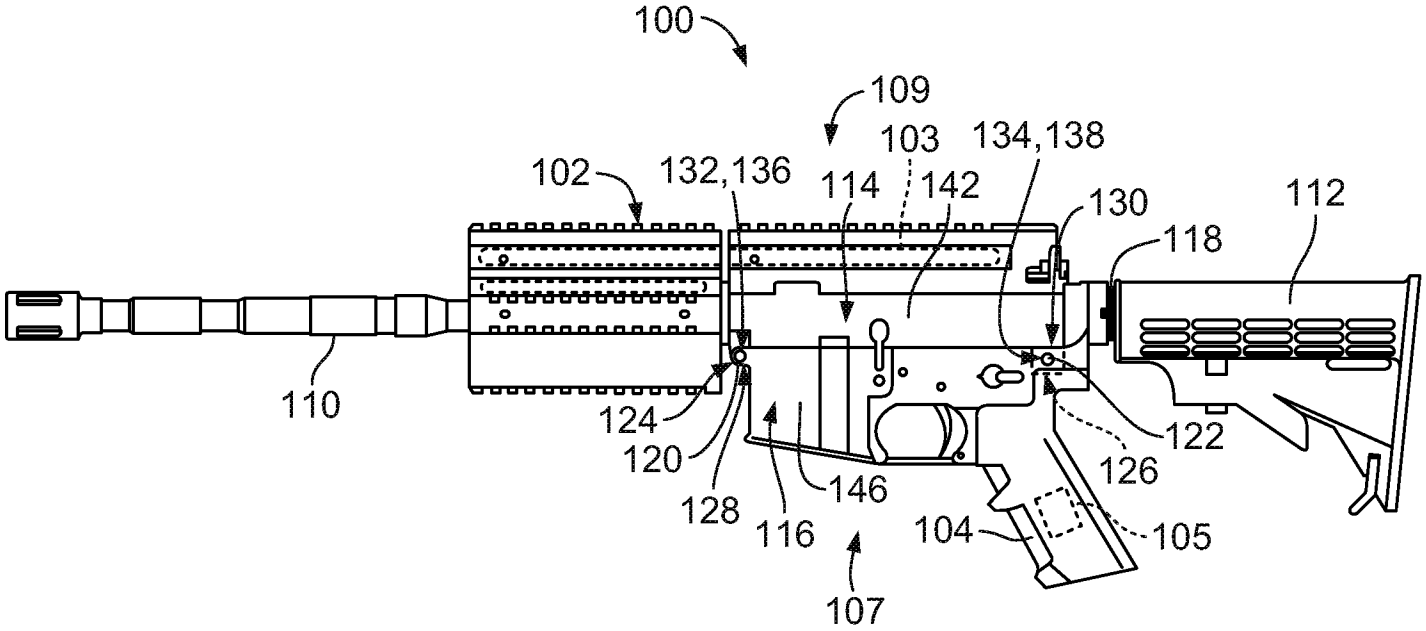
FIG. 1 is a side view of an exemplary embodiment of a weapon.
Figure 2:
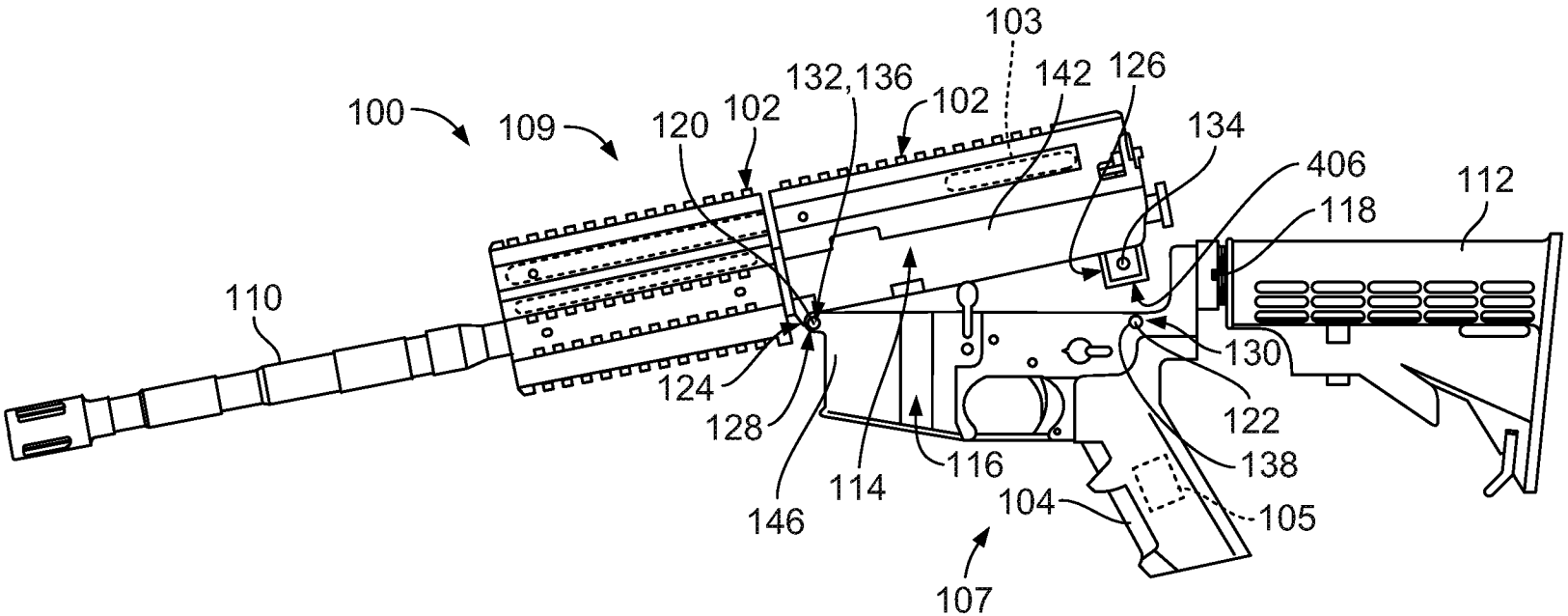
FIG. 2 is a side view of the weapon shown in FIG. 1 in an open state.

FIG. 1 is a side view of a weapon 100 formed in accordance with an exemplary embodiment and shown in a closed state. FIG. 2 is a side view of the weapon 100 in an open state. In the illustrated embodiment, the weapon 100 is an AR-15, M4, or M-16 style weapon, however, the weapon 100 is not limited thereto. Rather, the weapon 100 may be any other type of weapon with which an electrical connector may be used.

In an exemplary embodiment, the weapon 100 is of a type that includes a rail 102 having electronics 103 therein and a base 107 having electronics 105 therein. The base 107 includes a hand grip 104, a lower receiver 116 and a butt stock 112. The electronics 105 may be housed in any of the hand grip 104, the lower receiver 116, the butt stock 112, and/or any other component of the base 107. The base 107 may include other components of the weapon 100.

The weapon 100 includes a communication connector system (e.g., the communication connector system 106 shown in FIGS. 3 and 4 and/or the communication connector system 406 shown in FIG. 7) that communicatively connects the electronics 105 of the base 107 with the electronics 103 associated with the rail 102. The electronics 103 and 105 may be electrically connected, optically connected, inductively connected, and/or connected by other means that facilitate communicating signals, data, electrical power, and/or the like therebetween. The communication connector system transmits power and/or data between the rail 102 and the base 107. The communication connector system includes connectors that are easily and repeatedly mated and unmated as the weapon 100 is moved between the closed state (shown in FIG. 1) and the open state (shown in FIG. 2). The communication connector system and/or one or more individual components thereof may be an after market addition for the weapon 100.

Figure 4:
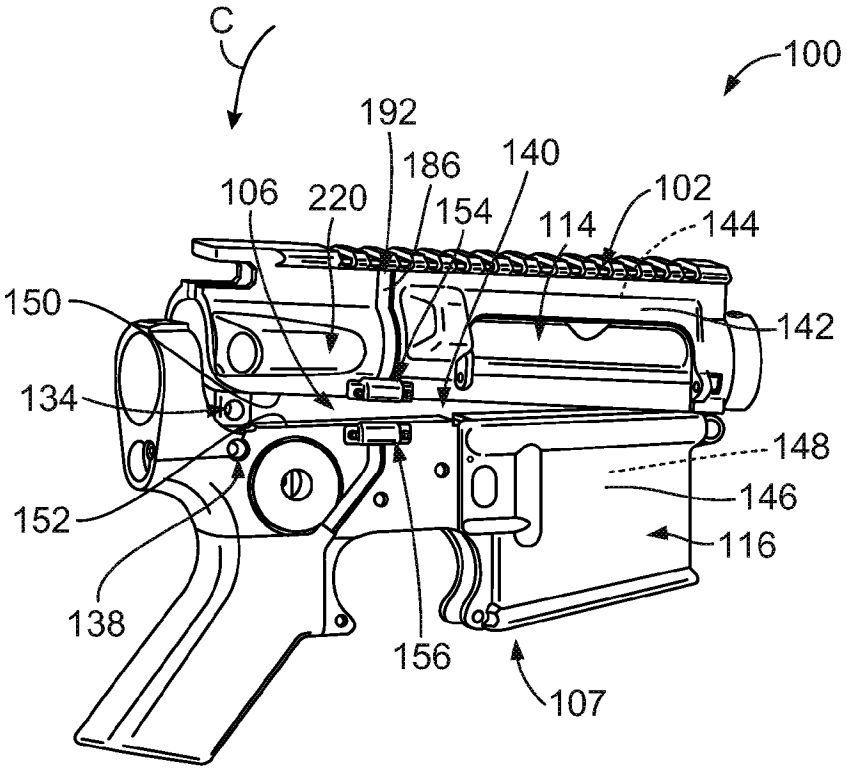
FIG. 4 is another perspective view of the weapon shown in FIGS. 1 and 2 illustrating the weapon in the open state.

In an exemplary embodiment, the communication connector system also includes an external connector (not shown; e.g., a tether connector housed within the cylindrical projection 220 shown in FIG. 4) for interfacing with an external connector, such as an electrical connector and/or fiber optic connector provided at an end of cable extending from the user of the weapon 100. Data and/or power may be transmitted to and/or from the user and the weapon 100 via the external connector. The communication connector system connectorizes the interface between the base 107 and the rail 102.

The weapon 100 includes an upper part 109 that is coupled to the lower part or base 107. The upper part 109 includes a barrel 110, an upper receiver 114 and the rail 102. The upper part 109 may include other components. The barrel 110 is provided at one end of the weapon 100 and the stock 112 is provided at the opposite end of the weapon 100. The weapon 100 includes the upper receiver 114 and the lower receiver 116, which are configured to be coupled to one another and at least partially de-coupled from one another. The lower receiver 116 includes a buffer tube 118 extending rearward therefrom. The stock 112 is coupled to the buffer tube 118. The hand grip 104 is connected to or part of the lower receiver 116. The rail 102 is connected to or part of the upper receiver 114. The barrel 110 is held by the upper receiver 114. The stock 112 is held by the lower receiver 116.

The upper receiver 114 is coupled to the lower receiver 116 using a front takedown pin 120 and a rear takedown pin 122. The takedown pins 120 and 122 may be removable from the weapon 100 to disassemble the weapon 100, such as, but not limited to, for repair, replacement, and/or cleaning of the various components of the weapon 100. Optionally, rather than removing the takedown pins 120 and/or 122 from the weapon 100, the takedown pins 120, 122 may remain attached to the upper receiver 114 and/or the lower receiver 116 while being unmated from the other of the upper receiver 114 or the lower receiver 116.

The upper receiver 114 is configured to be coupled to the lower receiver 116 in a closed position (shown in FIG. 1) and at least partially de-coupled from the lower receiver 116 in an open position (the exemplary embodiment of which is shown in FIG. 2). In other words, the upper receiver 114 is movable between the closed position and the open position. In the exemplary embodiment of the open position shown in FIG. 2, the rear takedown pin 122 is removed or released but the front takedown pin 120 remains installed, such that the upper receiver 114 is rotatably coupled to the lower receiver 116 at the front takedown pin 120. Accordingly, in the exemplary embodiment, the upper receiver 114 rotates between the open and closed position and remains partially coupled to the lower receiver 116 in the open position. In other words, the upper receiver 116 is only partially de-coupled from the lower receiver 114 in the exemplary embodiment of the open position shown in FIG. 2. But, in other embodiments, both takedown pins 120 and 122 are removed or released to move the upper receiver 114 from the closed position to the open position, such that the upper receiver 114 is completely separated from the lower receiver 116 in the open position. In such other embodiments, the upper receiver 114 is completely de-coupled from the lower receiver 116 in the open position.

In the open position of the upper receiver 114, internal components of the weapon 100 may be accessed, such as, but not limited to, for removing a cartridge, casing, and/or projectile jammed in the weapon 100, for cleaning the barrel 110, and/or the like. To accommodate the opening and the closing of the upper receiver 114, the communication connector system includes a separable interface that is readily and easily mated and unmated.

In an exemplary embodiment, the upper receiver 114 includes a front attachment member 124 and a rear attachment member 126. The lower receiver 116 includes a front attachment member 128 and a rear attachment member 130. The upper receiver 114 is attached to the lower receiver 116 at the front and rear attachment members 124-130. The front attachment members 124 and 128 are attached to one another using the front takedown pin 120. The rear attachment members 126 and 130 are attached to one another using the rear takedown pin 122.

The upper receiver 114 includes a front takedown pin opening 132 at the front attachment member 124. The upper receiver 114 includes a rear takedown pin opening 134 at the rear attachment member 126. The lower receiver 116 includes a front takedown pin opening 136 at the front attachment member 128. The lower receiver 116 includes a rear takedown pin opening 138 at the rear attachment member 130. The front takedown pin openings 132 and 136 are aligned with one another, and the front takedown pin 120 is inserted into the front takedown pin openings 132 and 136 to couple the upper receiver 114 to the lower receiver 116 at the front attachment members 124 and 128. The rear takedown pin openings 134 and 138 are aligned with one another when the upper receiver 114 is in the closed position to receive the rear takedown pin 122 therethrough. In the open position (FIG. 2), the front takedown pin openings 132 and 136 are not aligned with one another, but rather are spaced apart from one another. Each of the pin openings 132 and 134 may be referred to herein as an "upper pin opening", while each of the pin openings 136 and 138 may be referred to herein as a "lower pin opening".

The electronics 105 in the hand grip 104 may include various different types of components, such as, but not limited to, batteries, circuit boards, flex circuits, switches, connectors, and/or the like. The electronics 105 may be associated with external switches or buttons on the base 107 (such as, but not limited to, on the hand grip 104 and/or another grip of the weapon 100), which for example may be used for activating various features of the weapon 100, such as, but not limited to, a laser, a night vision scope, a camera, a rangefinder, a telescopic scope, and/or other devices and/or systems associated with the weapon 100.

The electronics 103 associated with the rail 102 may include various different types of components, such as, but not limited to, circuit boards, flex circuits, lasers, night vision scopes, telescopic scopes, rangefinders, cameras, and/or other types of components and/or devices associated with the weapon 100. The communication connector system is used to interconnect the electronics 105 in the base 107 with the electronics 103 associated with the rail 102.

Figure 3:
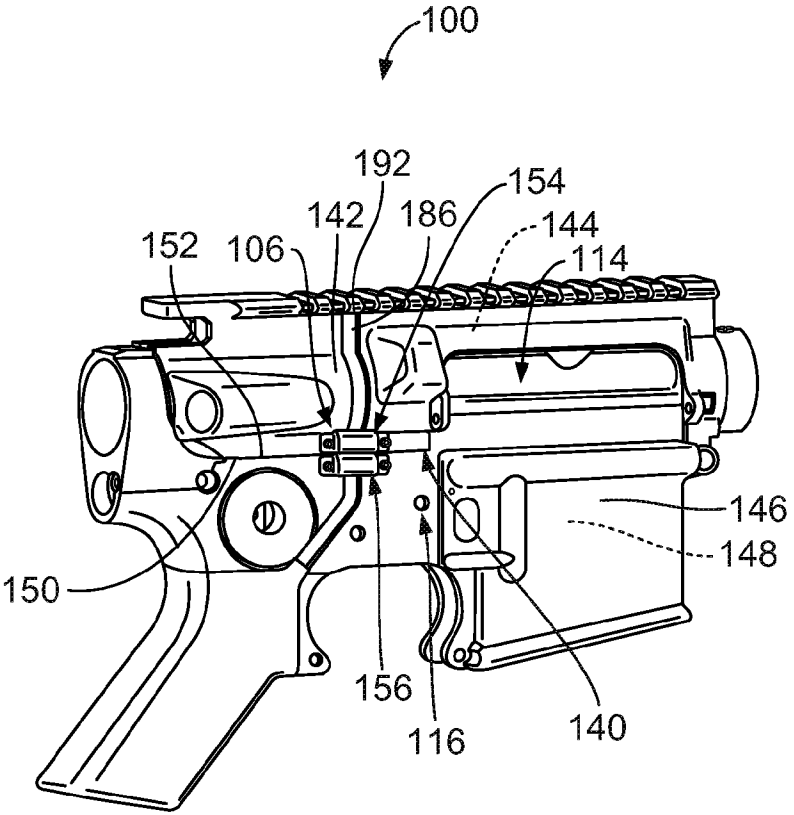
FIG. 3 is a perspective view of the weapon shown in FIGS. 1 and 2 illustrating an exemplary embodiment of a communication connector system of the weapon.

FIGS. 3 and 4 are perspective views of the weapon 100 illustrating an exemplary embodiment of the communication connector system 106. The upper receiver 114 is shown in the closed position in FIG. 3 and in the open position in FIG. 4. When the upper receiver 114 is moved from the open position to the closed position, the upper receiver 114 and the lower receiver 116 come together at an interface 140. The upper receiver 114 includes opposite exterior side surfaces 142 and 144. The lower receiver 116 includes opposite exterior side surfaces 146 and 148. The exterior side surfaces 142 and 146 are visible in FIGS. 3 and 4, while the exterior side surfaces 144 and 148 (that are opposite the exterior side surfaces 142 and 146) are visible in FIGS. 1 and 2.

The upper receiver 114 includes an interface surface 150 that intersects the exterior side surfaces 142 and 144 of the upper receiver 114. The lower receiver 116 includes an interface surface 152 that intersects the exterior side surfaces 144 and 146 of the lower receiver 116. When the upper receiver 114 is in the closed position, the interface surfaces 150 and 152 engage each other at the interface 140 between the receivers 114 and 116. As best seen in FIGS. 2 and 4, in the illustrated embodiment, the interface surface 150 of the upper receiver 114 extends approximately perpendicular to adjacent portions of each of the exterior side surfaces 142 and 144. "Adjacent portions" is intended to mean segments of the surfaces 142 and 144 that are near and/or at where the interface surface 150 intersects the surfaces 142 and 144. But, the interface surface 150 may extend at any non-parallel angle relative to adjacent portions of each of the exterior sides surfaces 142 and 144. In the illustrated embodiment, the interface surface 152 of the lower receiver 116 extends approximately perpendicular to adjacent portions of each of the exterior side surfaces 146 and 148. But, the interface surface 152 may extend at any non-parallel angle relative to adjacent portions of each of the exterior sides surfaces 146 and 148. The interface surface 150 may be referred to herein as an "upper interface surface". The interface surface 152 may be referred to herein as a "lower interface surface".

The communication connector system 106 includes separable connectors 154 and 156 provided at or adjacent the interface 140 between the upper receiver 114 and the lower receiver 116. The separable connectors 154 and 156 of the communication connector system 106 are automatically mated when the upper receiver 114 is moved from the open to the closed position, and are automatically unmated when the upper receiver 114 is moved from the closed position to the open position.

The connectors 154 and 156 of the communication connector system 106 are associated with the upper receiver 114 and the lower receiver 116, respectively. Specifically, the connector 154 is mounted directly to the exterior side surface 142 of the upper receiver 114, while the connector 154 is mounted directly to the exterior side surface 1146 of the lower receiver 116. The connector 154 is movable with the upper receiver 114 such that the connector 154 is matable with, and unmatable from, the connector 156 as the upper receiver 114 moves between the open and closed positions. The rear takedown pin 122 (FIGS. 1 and 2) secures the connector 154 in a mated state with the connector 156 when securing the upper receiver 114 to the lower receiver 116. In some alternative embodiments, the connectors 154 and 156 are mounted directly to the exterior sides surfaces 144 and 148, respectively, or, in addition to the connector system 106, the weapon includes another connector system (not shown) having connectors (not shown) mounted to the surfaces 144 and 148. The connector 154 may be referred to herein as an "upper connector", while the connector 156 may be referred to herein as a "lower connector".

Figure 5:
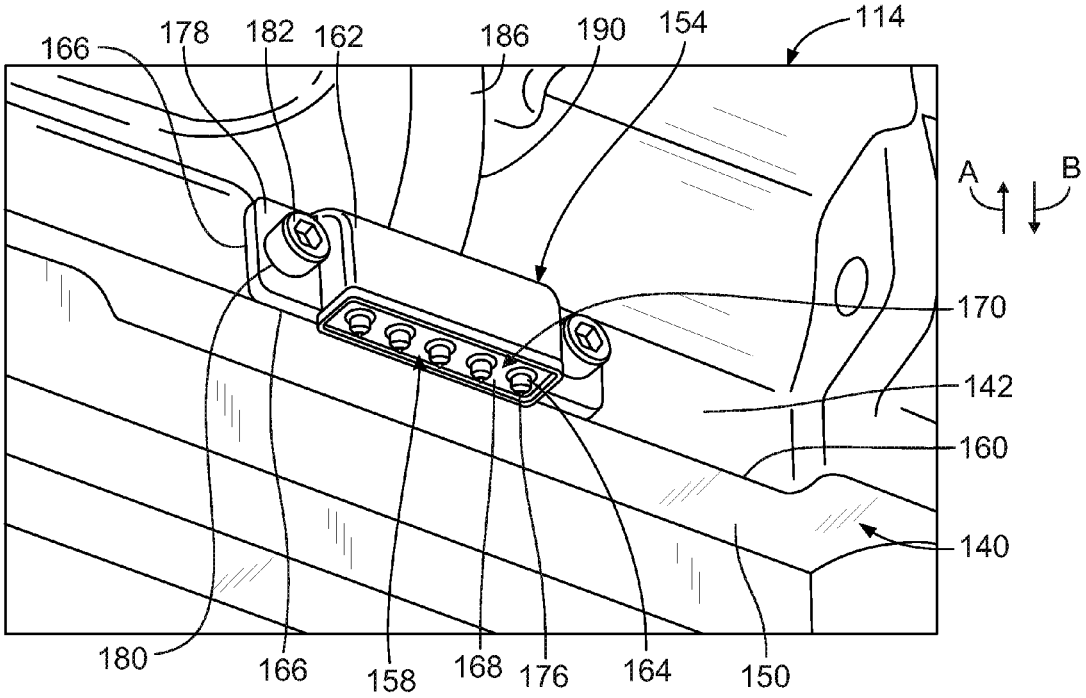
FIG. 5 is a perspective view of a portion of an exemplary embodiment of an upper receiver of the weapon shown in FIGS. 1-4.
Figure 6:
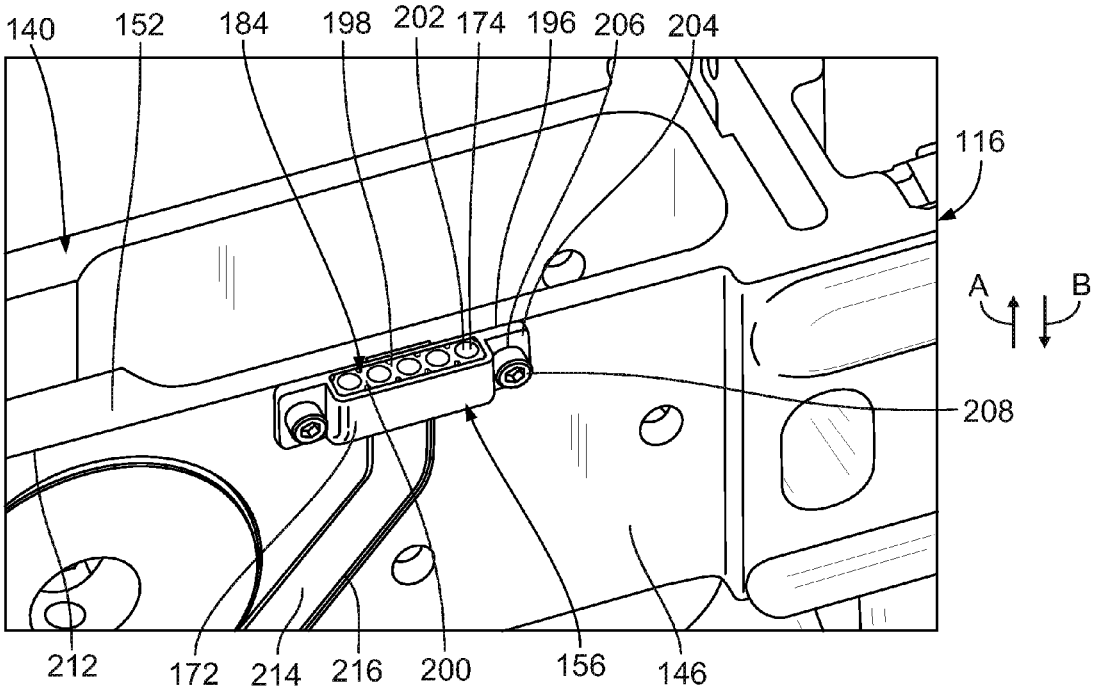
FIG. 6 is a perspective view of a portion of an exemplary embodiment of a lower receiver of the weapon shown in FIGS. 1-4.

FIG. 5 is a perspective view of the upper receiver 114 illustrating an exemplary embodiment of the connector 154. The connector 154 includes a mating interface 158 that is configured to be mated with the connector 156 (FIGS. 3, 4, and 6). The mating interface 158 faces generally toward the lower receiver 116. Optionally, the connector 154 includes a seal (not shown; such as, but not limited to, a gasket and/or the like) that extends around, at, and/or within a perimeter of the mating interface 158 and that engages the connector 156, for example to seal the mating interface 158 when the connectors 154 and 156 are mated together.

The connector 154 includes a housing 162 and one or more contacts 164 that are held by the housing 162. The housing 162 includes a mounting surface 166 and a mating interface surface 168. In the illustrated embodiment, a wall 170 of the housing 162 defines the mating interface surface 168. In other embodiments, a portion or all of the mating interface surface 168 may be defined by a dielectric insert (not shown) that is held by the housing 162. The mating interface surface 168 may or may not engage a housing 172 (FIG. 6) and/or a dielectric insert (not shown) of the connector 156 when the connectors 154 and 156 are mated together. The mating interface surface 168 may be considered to define a portion of the mating interface 158 of the connector 154. Although shown as including the shape of a parallelepiped, the housing 162 may additionally or alternatively include any other shape. Moreover, in some alternative embodiments, the housing 162 and/or a dielectric insert held by the housing 162 defines a socket (not shown) that receives a plug (not shown) of the connector 156 or defines a plug (not shown) that is configured to be received within a socket (not shown) of the connector 156.

The contacts 164 are configured to be communicatively connected to corresponding contacts 174 (FIG. 6) of the connector 156. In the illustrated embodiment, the contacts 164 are pogo pins, however other types of contacts are possible in alternative embodiments, such as, but not limited to, spring fingers, contact pads, and/or the like. The contacts 164 include mating interfaces 176 that are exposed along the mating interface surface 168 of the housing 162 and that mate with the corresponding contacts 174 of the connector 156. The mating interfaces 176 of the contacts 164 define at least a portion of the mating interface 158 of the connector 154.

The contacts 164 define a separable mating interface 158 for the connector 154. For example, the contacts 164 may be readily and easily mated to, and unmated from, the contacts 174 as the upper receiver 114 is moved between the open and closed positions. Although five are shown, the connector 154 may include any number of contacts 164. Optionally, one or more of the mating interfaces 176 is angled at an oblique angle (e.g., relative to a central longitudinal axis of the contact 164), for example to provide at least some contact wipe when mating with the corresponding contact 174.

In the illustrated embodiment, the mating interfaces 176 of the contacts 164 extend outward from the mating interface surface 168 of the housing 162. In other embodiments, at least a portion of one or more of the mating interfaces 176 is aligned with the mating interface surface 168 and/or at least a portion of one or more of the mating interfaces 176 is recessed below the mating interface surface 168. Although shown as being arranged in a single row, the mating interfaces 176 of the contacts 164 may be arranged in any configuration, pattern, arrangement, and/or the like, such as, but not limited to, a rectangular pattern having any number of rows and/or columns, a circular or otherwise curved pattern, and/or the like.

As described above, the connector 154 is mounted directly to the exterior side surface 142 of the upper receiver 114. By "mounted directly" it is meant that some component of the connector 154 is in direct physical contact with the exterior side surface 142 of the upper receiver 114. In the illustrated embodiment, the housing 162 is in direct physical contact with the exterior side surface 142. Specifically, the housing 162 is mounted directly to the exterior side surface 142 such that the mounting surface 166 of the housing 162 is in direct physical contact with the exterior side surface 142.

The connector 154 may be mounted directly to the exterior side surface 142 of the upper receiver 114 using any structure, means, fastener, and/or the like, such as, but not limited to, one or more threaded fasteners, an adhesive, a dovetail arrangement, and/or the like. For example, in the illustrated embodiment, the housing 162 includes mounting ears 178 that include openings 180 that receive corresponding threaded fasteners 182 therethrough. The threaded fasteners 182 threadably connect to the upper receiver 114 via nuts (not shown) and/or threaded openings (not shown) of the upper receiver 114 to directly mount the connector 154 to the exterior side surface 142 of the upper receiver 114. In addition or alternative to the mounting ears 178 and/or the threaded fasteners 182, and for example, an adhesive may extend between the mounting surface 166 of the housing 162 and the exterior side surface 142 of the upper receiver 114 to directly mount the connector 154 to the exterior side surface 142 of the upper receiver 114.

The connector 154 may be mounted at any location along the length (defined as extending between the barrel 110 and the butt stock 112 of the weapon 100) of the upper receiver 114 that enables the connector 154 to mate with, and unmate from, the connector 156 as the upper receiver 114 is moved between the open and closed positions.

In the illustrated embodiment, the mating interface 158 of the connector 154 is generally aligned with an edge 160 of the upper receiver 114 where the exterior side surface 142 intersects the interface surface 150 of the upper receiver 114. In other words, the mating interface 158 is generally aligned with the interface surface 150, and thus the interface 140, in the illustrated embodiment. Accordingly, in the illustrated embodiment, the mating interface 158 of the connector 154 mates with a mating interface 184 (FIG. 6) of the connector 156 at the interface 140 between the upper receiver 114 and the lower receiver 116. In other embodiments, the mating interface 158 of the connector 154 is spaced apart (i.e., offset) from the edge 160 in the direction of the arrow A or B of FIG. 5. In such other embodiments, the mating interface 158 of the connector 154 mates with the mating interface 184 of the connector 154 at a location that is adjacent to, but spaced apart from in the direction A or B, the interface 140 between the receivers 114 and 116.

The communication connector system 106 includes one or more communication conductors 186 that electrically, optically, inductively and/or otherwise connect the contacts 164 of the connector 154 to the electronics 103 (FIGS. 1 and 2) associated with the rail 102 (FIGS. 1, 2, and 4). Each communication conductor 186 may be any type of optical, electrical, inductive, or other type of conductor, such as, but not limited to, a wire, a fiber, a cable, and/or the like. Other examples of communication conductors 186 include, but are not limited to, a circuit board, a flex circuit, a conductor of a circuit board, a conductor of a flex circuit, a conductor of a cable, and/or the like. The system 106 may include any number of communication conductors 186.

The upper receiver 114 may include one or more channels 190 that extend within the exterior side surface 142. In the illustrated embodiment, and as can be seen in FIGS. 3 and 4, the channel 190 extends from the connector 154 to an interface 192 (FIGS. 3 and 4; e.g., an opening that provides access to the electronics 103) with the electronics 103 associated with the rail 102. But, each channel 190 may extend along only a portion of a path that extends from the connector 154 to the interface 192. In other words, each channel 190 may extend only partially between the connector 154 and the interface 192. The interface 192 may have any location(s) along the upper receiver 114. The upper receiver 114 may include any number of channels 190.

The communication conductors 186 extend within the channel 190. Each channel 190 may hold any number of communication conductors 186. In the illustrated embodiment, a single channel 190 is provided that holds a single communication conductor 196. The exemplary communication conductor 196 is a flex circuit that extends within the channel 190. Any portion, amount, and/or the like of each communication conductor 186 may extend within the channel 190. In the illustrated embodiment, the communication conductor 186 extends within the channel 190 such that the communication conductor 186 is aligned with or under (i.e., does not extend past) the edge of the channel 190 where the exterior side surface 142 intersects the channel 190. Extension of all of a portion of one or more communication conductors 186 within one or more channels 190 may facilitate protecting the communication conductors 186 from damage and/or may facilitate preventing one or more communication conductors 186 from catching or snagging.

FIG. 6 is a perspective view of the lower receiver 116 illustrating an exemplary embodiment of the connector 156. The connector 156 includes the mating interface 184 that is configured to be mated with the connector 154 (FIGS. 3, 4, and 5). The mating interface 184 faces generally toward the upper receiver 114. Optionally, the connector 156 includes a seal (not shown; such as, but not limited to, a gasket and/or the like) that extends around, at, and/or within a perimeter of the mating interface 184 and that engages the connector 154, for example to seal the mating interfaces 158 and 184 between the connectors 154 and 156.

The connector 156 includes the housing 172 and one or more of the contacts 174, which are held by the housing 172. The housing 172 includes a mounting surface 196 and a mating interface surface 198. In the illustrated embodiment, a dielectric insert 200 defines the mating interface surface 198.

In other embodiments, a portion or all of the mating interface surface 198 may be defined by a wall (not shown) of the housing 172. The mating interface surface 198 may or may not engage the housing 162 (FIG. 5) and/or a dielectric insert (not shown) of the connector 154 when the connectors 154 and 156 are mated together. The mating interface surface 198 may be considered to define a portion of the mating interface 184 of the connector 156. Although shown as including the shape of a parallelepiped, the housing 172 may additionally or alternatively include any other shape.

The contacts 174 are configured to be communicatively connected to the corresponding contacts 164 (FIG. 5) of the connector 154. In the illustrated embodiment, the contacts 174 are contact pads. But, each contact 174 may be any other type of contact, such as, but not limited to, spring fingers, pogo pins, and/or the like. The contacts 174 include mating interfaces 202 that are exposed along the mating interface surface 198 of the housing 172 and that mate with the mating interfaces 176 (FIG. 5) of the corresponding contacts 164. The mating interfaces 202 of the contacts 174 define at least a portion of a separable mating interface 184 of the connector 156. For example, the contacts 174 may be readily and easily mated to, and unmated from, the contacts 164 as the upper receiver 114 is moved between the open and closed positions. Although five are shown, the connector 156 may include any number of contacts 174.

In the illustrated embodiment, the mating interfaces 202 of the contacts 174 extend relatively slightly outward from the mating interface surface 198. In other embodiments, at least a portion of one or more of the mating interfaces 202 is aligned with the mating interface surface 198 and/or at least a portion of one or more of the mating interfaces 202 is recessed below the mating interface surface 198. Although shown as being arranged in a single row, the mating interfaces 202 of the contacts 174 may be arranged in any configuration, pattern, arrangement, and/or the like, such as, but not limited to, a rectangular pattern having any number of rows and/or columns, a circular or otherwise curved pattern, and/or the like.

The connector 156 is mounted directly to the exterior side surface 146 of the lower receiver 116. By "mounted directly" it is meant that some component of the connector 156 is in direct physical contact with the exterior side surface 146 of the lower receiver 116. In the illustrated embodiment, the housing 172 is mounted directly to the exterior side surface 146 such that the mounting surface 196 of the housing 172 is in direct physical contact with the exterior side surface 146. The connector 156 may be mounted directly to the exterior side surface 146 of the lower receiver 116 using any structure, means, fastener, and/or the like, such as, but not limited to, one or more threaded fasteners, an adhesive, a dovetail arrangement, and/or the like. For example, in the illustrated embodiment, the housing 172 includes mounting ears 204 with openings 206 that receive corresponding threaded fasteners 208 therethrough. The threaded fasteners 208 threadably connect to the lower receiver 116 via nuts (not shown) and/or threaded openings (not shown) of the lower receiver 116. In addition or alternative to the mounting ears 204 and/or the threaded fasteners 208, and for example, an adhesive may extend between the mounting surface 196 of the housing 172 and the exterior side surface 146 of the lower receiver 116.

The connector 156 may be mounted at any location along the length (defined as extending between the barrel 110 and the butt stock 112 of the weapon 100) of the lower receiver 116 that enables the connector 156 to mate with, and unmate from, the connector 154 as the upper receiver 114 is moved between the open and closed positions. In the illustrated embodiment, the mating interface 184 of the connector 156 is generally aligned with an edge 212 of the lower receiver 116 where the exterior side surface 146 intersects the interface surface 152 of the lower receiver 116. In other words, the mating interface 184 is generally aligned with the interface surface 152, and thus the interface 140, in the illustrated embodiment. Accordingly, in the illustrated embodiment, the mating interface 184 of the connector 156 mates with the mating interface 158 (FIG. 5) of the connector 154 at the interface 140 between the upper receiver 114 and the lower receiver 116. In other embodiments, the mating interface 184 of the connector 156 is spaced apart (i.e., offset) from the edge 212 in the direction of the arrow A or B of FIG. 6. In such other embodiments, the mating interface 184 of the connector 156 mates with the mating interface 158 of the connector 156 at a location that is adjacent to, but spaced apart from in the direction A or B, the interface 140 between the receivers 114 and 116.

The communication connector system 106 includes one or more communication conductors 214 that electrically, optically, inductively and/or otherwise connect the contacts 174 of the connector 156 to the electronics 105 (FIGS. 1 and 2) in the base 107 (FIGS. 1, 2, and 4). Each communication conductor 214 may be any type of optical, electrical, inductive, or other type of conductor, such as, but not limited to, a wire, a fiber, a cable, a circuit board, a flex circuit, a conductor of a circuit board, a conductor of a flex circuit, a conductor of a cable, and/or the like. The system 106 may include any number of communication conductors 214.

The lower receiver 116 may include one or more channels 216 that extend within the exterior side surface 146. In the illustrated embodiment, and as can be seen in FIGS. 3 and 4, the channel 216 extends from the connector 156 to an interface 218 (FIGS. 3 and 4; e.g., an opening that provides access to the electronics 105) with the electronics 105 in the base 107. But, each channel 216 may extend along only a portion of a path that extends from the connector 156 to the interface 218. In other words, each channel 216 may extend only partially between the connector 156 and the interface 218. The interface 218 may have any location(s) along the lower receiver 116. The lower receiver 116 may include any number of channels 216.

The communication conductors 214 extend within the channel 216. Each channel 216 may hold any number of communication conductors 214. In the illustrated embodiment, a single channel 216 is provided that holds a single communication conductor 214. The exemplary communication conductor 214 is a flex circuit that extends within the channel 216. Any portion, amount, and/or the like of each communication conductor 214 may extend within the channel 216. In the illustrated embodiment, the communication conductor 216 extends within the channel 214 such that the communication conductor 214 is aligned with or under (i.e., does not extend past) the edge of the channel 216 where the exterior side surface 146 intersects the channel 216. Extension of all of a portion of one or more communication conductors 214 within one or more channels 216 may facilitate protecting the communication conductors 214 from damage and/or may facilitate preventing one or more communication conductors 214 from catching or snagging.

Referring again to FIG. 4, the upper receiver 114 is shown in the open position. The upper receiver 114 is pivoted towards the lower receiver 116, such as in the direction of arrow C, as the upper receiver 114 is moved to the closed position. The rear takedown pin opening 134 of the upper receiver 114 is aligned with the rear takedown pin opening 138 of the lower receiver 116. As the upper receiver 114 is moved to the closed position, the connector 154 of the upper receiver 114 is moved into engagement with the connector 156 of the lower receiver. The contacts 164 (FIG. 5) of the connector 154 engage the contacts 174 (FIG. 6) of the connector 156. A separable interface is defined between the contacts 164 and the contacts 176. The contacts 164 automatically engage the contacts 174 when the upper receiver 114 is rotated to the closed position. No separate action is required by the user. For example, the user does not need to separately plug or mate the connectors 154 and 156 together. No guidance is required by the user for guiding the connector 154 to the connector 156 as the upper receiver 114 is moved to the closed position. Having the connector 154 mounted directly to the exterior side surface 142 of the upper receiver 114 at or adjacent the interface 140 and having the connector 156 mounted directly to the exterior side surface 146 of the lower receiver 116 at or adjacent the interface 140 ensures that the connectors 154 and 156 are aligned so that the connector 154 automatically mates with the connector 156 as the upper receiver 114 is moved to the closed position.

In the closed position, the takedown pin openings 134 and 138 are aligned with one another to receive the rear takedown pin 122. When the rear takedown pin 122 is positioned within the takedown pin openings 134 and 138, the connector 154 is locked in a mated position with the connector 156. The connector 154 cannot be unmated from the connector 156 without removing the rear takedown pin 122.

The weapon 100 may include a tether connector (not shown; e.g., a tether connector housed within the cylindrical projection 220) that is communicatively connected to the electronics 105 (FIGS. 1 and 2) in the base 107, to the electronics 103 (FIGS. 1 and 2) associated with the rail 102, and/or to the communication connector system 106. The tether connector is externally accessible and is configured for connection to an external connector (not shown), such as, but not limited to, a connector terminated to an end of a cable extending from a user. Data and/or power may be transmitted to and/or from the user via the external connector and the tether connector.

Figure 7:
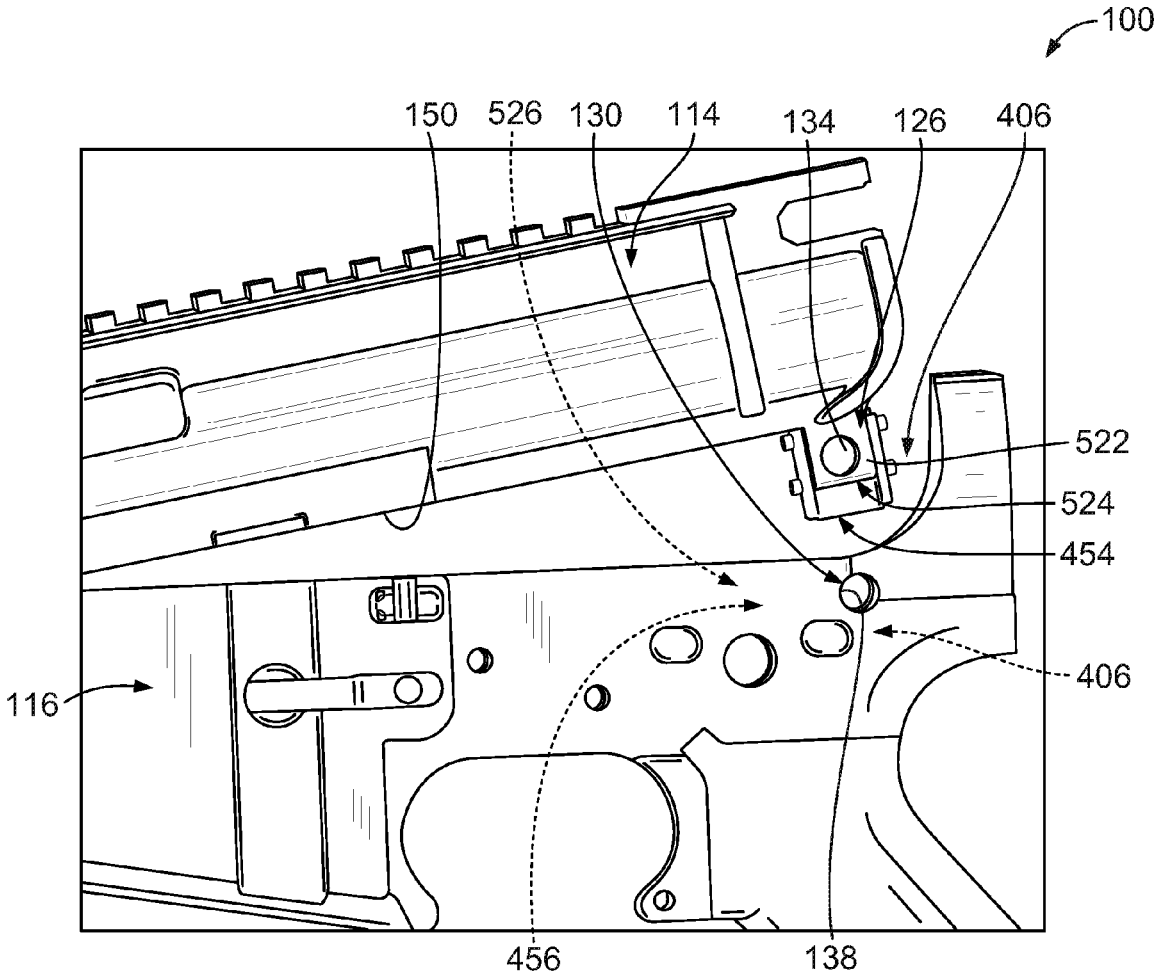
FIG. 7 is a perspective view of a portion of the weapon shown in FIGS. 1 and 2 illustrating another exemplary embodiment of a communication connector system of the weapon.

FIG. 7 is a perspective view of the weapon 100 illustrating an exemplary embodiment of the communication connector system 406. The communication connector system 406 may be used with the weapon in addition or alternatively to the communication connector system 106 (FIGS. 3-6). The upper receiver 114 is shown in the open position in FIG. 7.

The upper receiver 114 includes the rear attachment member 126. The lower receiver 116 includes the rear attachment member 130. The rear attachment members 126 and 130 are attached to one another using the rear takedown pin 122 (FIGS. 1 and 2). Specifically, the rear attachment member 126 of the upper receiver 114 includes an extension 522 that extends outwardly from the interface surface 150 of the upper receiver to an end 524. The extension 522 includes the rear takedown pin opening 134. The lower receiver 116 includes a cavity 526 (best seen in FIG. 8) that receives the extension 522 of the rear attachment member 130 therein as the upper receiver 114 is moved from the open position to the closed position. The rear attachment member 130 of the lower receiver 116 includes the rear takedown pin opening 138. When the upper receiver 114 is in the closed position and the extension 522 is received within the cavity 526 of the lower receiver 116, the rear takedown pin openings 134 and 138 are aligned for receiving the rear takedown pin 122. In some alternative embodiments, the rear attachment member 130 of the lower receiver 116 includes an extension (not shown) that is received within a cavity (not shown) of the upper receiver 114 when the upper receiver 114 is in the closed position.

Figure 8:
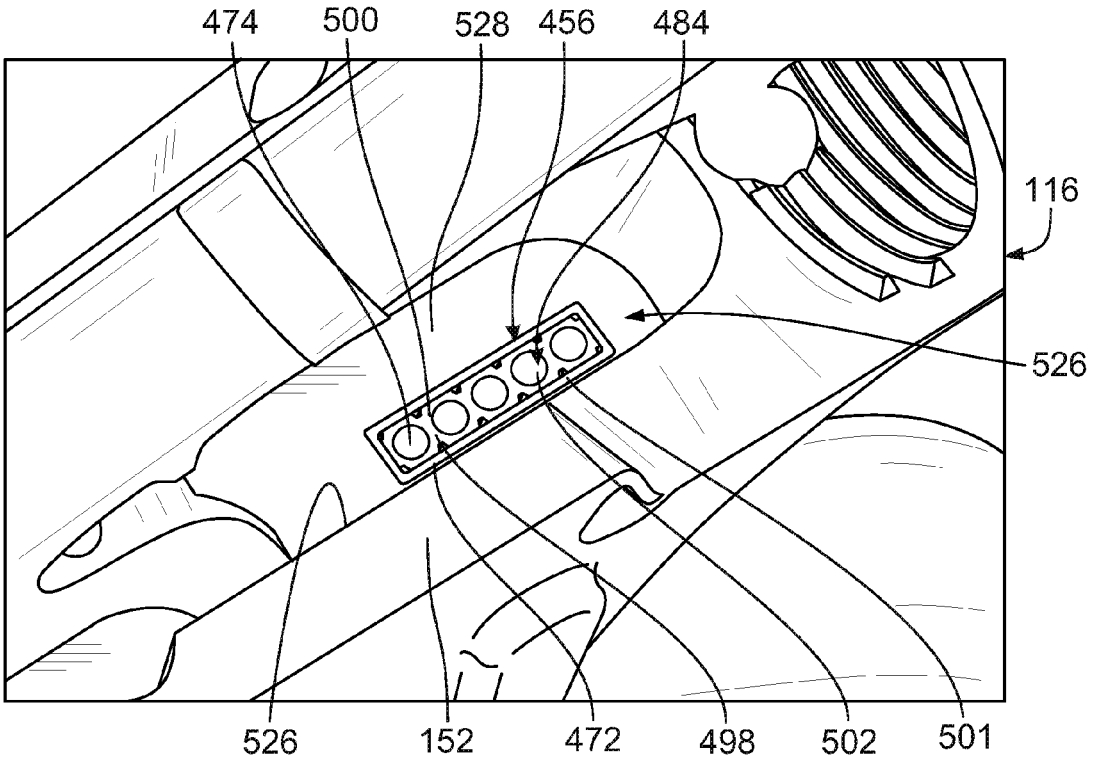
FIG. 8 is a perspective view of a portion of another exemplary embodiment of a lower receiver of the weapon shown in FIGS. 1 and 2.

The communication connector system 406 includes separable connectors 454 and 456 that are automatically mated when the upper receiver 114 is moved from the open to the closed position, and are automatically unmated when the upper receiver 114 is moved from the closed position to the open position. The connector 456 is best seen in FIG. 8. The connectors 454 and 456 of the communication connector system 406 are associated with the upper receiver 114 and the lower receiver 116, respectively. The connectors 454 and 456 are integrated into the rear attachment member 126 and 130 of the upper and lower receivers 114 and 116, respectively. For example, the connector 454 is integrated into the rear attachment member 126 of the upper receiver 114 by being mounted to the extension 522 of the rear attachment member 126, as will be described below. Moreover, and for example, the connector 456 is integrated into the rear attachment member 130 of the lower receiver 116 by being held within the cavity 526 of the lower receiver 116 that receives the rear attachment member 126 of the upper receiver 114 therein, as will be described below.

The connector 454 is movable with the upper receiver 114 such that the connector 454 is matable with, and unmatable from, the connector 456 as the upper receiver 114 moves between the open and closed positions. The rear takedown pin 122 secures the connector 454 in a mated state with the connector 456 when securing the upper receiver 114 to the lower receiver 116. The connector 454 may be referred to herein as an "upper connector", while the connector 456 may be referred to herein as a "lower connector".

Figure 9:
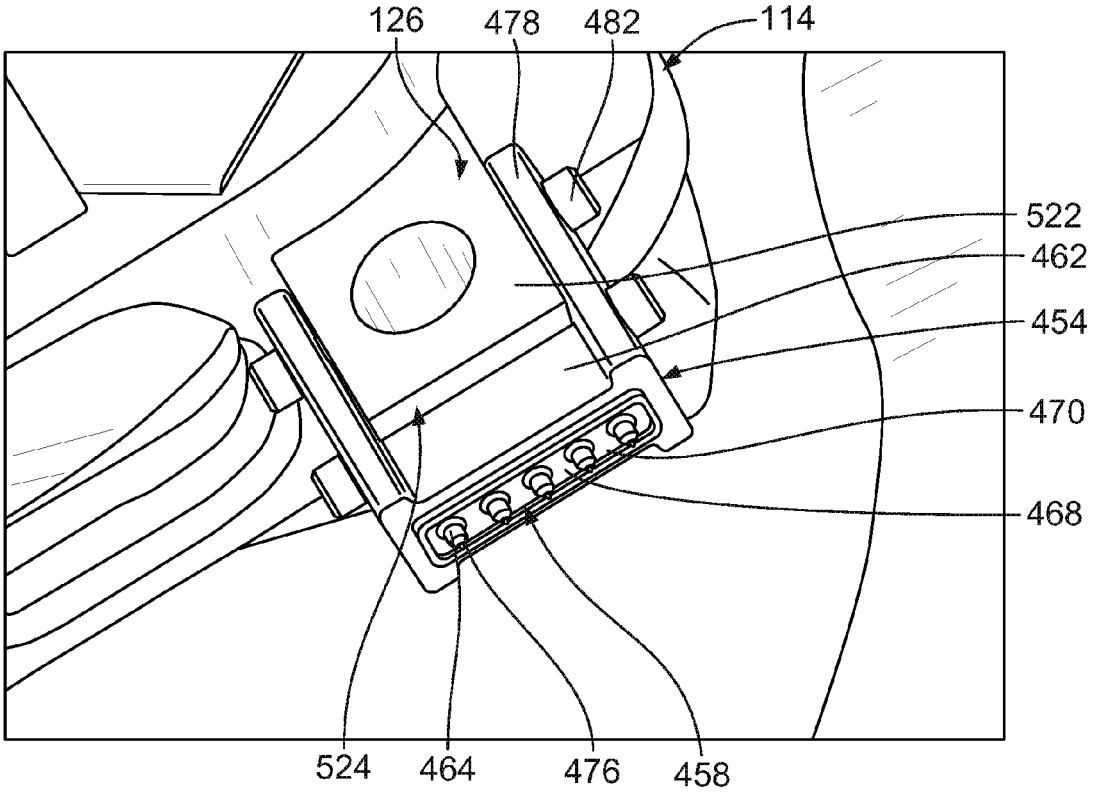
FIG. 9 is a perspective view of a portion of another exemplary embodiment of an upper receiver of the weapon shown in FIGS. 1 and 2.

FIG. 8 is a perspective view of a portion of the lower receiver 116 illustrating an exemplary embodiment of the connector 456. The cavity 526 of the lower receiver 116 extends into the interface surface 152 of the lower receiver 116 to a bottom wall 528. The connector 456 is mounted to the lower receiver 116 at the bottom wall 528. The connector 456 includes a mating interface 484 that is configured to be mated with the connector 454 (FIGS. 7 and 9). The mating interface 484 faces generally toward the upper receiver 114. Optionally, the connector 456 includes a seal (not shown; such as, but not limited to, a gasket and/or the like) that extends around, at, and/or within a perimeter of the mating interface 484 and that engages the connector 454, for example to seal the mating interface 484 when the connectors 454 and 456 are mated together.

The connector 456 includes a housing 472 and one or more contacts 474 that are held by the housing 472. The housing 472 includes a mating interface surface 498. In the illustrated embodiment, a dielectric insert 500 defines the mating interface surface 498. In other embodiments, a portion or all of the mating interface surface 498 may be defined by a wall 501 of the housing 472. The mating interface surface 498 may or may not engage a housing 462 (FIG. 9) and/or a dielectric insert (not shown) of the connector 454 when the connectors 454 and 456 are mated together. The mating interface surface 498 may be considered to define a portion of the mating interface 484 of the connector 456. Although shown as including the shape of a parallelepiped, the housing 472 may additionally or alternatively include any other shape. Moreover, in some alternative embodiments, the housing 472 and/or a dielectric insert held by the housing 472 defines a socket (not shown) that receives a plug (not shown) of the connector 454 or defines a plug (not shown) that is configured to be received within a socket (not shown) of the connector 454.

The contacts 474 are configured to be communicatively connected to corresponding contacts 464 (FIG. 9) of the connector 454. In the illustrated embodiment, the contacts 474 are contact pads, however other types of contacts are possible in alternative embodiments, such as, but not limited to, spring fingers, pogo pins, and/or the like. The contacts 474 include mating interfaces 502 that are exposed along the mating interface surface 498 of the housing 472 and that mate with the corresponding contacts 464 of the connector 454. The mating interfaces 502 of the contacts 474 define at least a portion of the mating interface 484 of the connector 456. The contacts 474 define a separable mating interface 484 for the connector 456. For example, the contacts 474 may be readily and easily mated to, and unmated from, the contacts 464 as the upper receiver 114 is moved between the open and closed positions. Although five are shown, the connector 456 may include any number of contacts 474.

In the illustrated embodiment, the mating interfaces 502 of the contacts 474 extend relatively slightly outward from the mating interface surface 498 and from the bottom wall 528. In other embodiments, at least a portion of one or more of the mating interfaces 502 is aligned with the mating interface surface 498 and/or the bottom wall 528, and/or at least a portion of one or more of the mating interfaces 502 is recessed below the mating interface surface 498 and/or the bottom wall 528. Although shown as being arranged in a single row, the mating interfaces 502 of the contacts 474 may be arranged in any configuration, pattern, arrangement, and/or the like, such as, but not limited to, a rectangular pattern having any number of rows and/or columns, a circular or otherwise curved pattern, and/or the like.

The connector 456 may be mounted to the bottom wall 528 using any structure, means, fastener, and/or the like, such as, but not limited to, one or more threaded fasteners, an adhesive, a dovetail arrangement, and/or the like. The connector 456 may be mounted at any location along the length (defined as extending between the barrel 110 and the butt stock 112 of the weapon 100) of the cavity 526 of the lower receiver 116 that enables the connector 456 to mate with, and unmate from, the connector 454 as the upper receiver 114 is moved between the open and closed positions.

The communication connector system 406 includes one or more communication conductors (not shown) that electrically, optically, inductively and/or otherwise connect the contacts 474 of the connector 456 to the electronics 105 (FIGS. 1 and 2) in the base 107. Each communication conductor may be any type of optical, electrical, inductive, or other type of conductor, such as, but not limited to, a wire, a fiber, a cable, and/or the like. Other examples of communication conductors include, but are not limited to, a circuit board, a flex circuit, a conductor of a circuit board, a conductor of a flex circuit, a conductor of a cable, and/or the like. The system 406 may include any number of communication conductors for communicatively connecting the connector 456 to the electronics 105.

FIG. 9 is a perspective view of a portion of the upper receiver 114 illustrating an exemplary embodiment of the connector 454. The connector 454 is mounted to the extension 522 of the rear attachment member 126 such that the connector 454 extends outwardly from the end 524 of the extension 522. But, the connector 454 may be mounted at any other location along extension 522 that enables the connector 454 to mate with, and unmate from, the connector 456 (FIGS. 7 and 8) as the upper receiver 114 is moved between the open and closed positions.

The connector 454 includes a mating interface 458 that is configured to be mated with the mating interface 484 (FIG. 8) of the connector 456. The mating interface 458 faces generally toward the lower receiver 116. Optionally, the connector 454 includes a seal (not shown; such as, but not limited to, a gasket and/or the like) that extends around, at, and/or within a perimeter of the mating interface 458 and that engages the connector 456, for example to seal the mating interface 458 when the connectors 454 and 456 are mated together.

The connector 454 includes a housing 462 and one or more contacts 464 that are held by the housing 462. The housing 462 includes a mating interface surface 468. In the illustrated embodiment, a wall 470 of the housing 462 defines the mating interface surface 468. In other embodiments, a portion or all of the mating interface surface 468 may be defined by a dielectric insert (not shown) that is held by the housing 462. The mating interface surface 468 may or may not engage the housing 472 (FIG. 8) and/or a dielectric insert (not shown) of the connector 456 when the connectors 454 and 456 are mated together. The mating interface surface 468 may be considered to define a portion of the mating interface 458 of the connector 454. Although shown as including the shape of a parallelepiped, the housing 462 may additionally or alternatively include any other shape. Moreover, in some alternative embodiments, the housing 462 and/or a dielectric insert held by the housing 462 defines a socket (not shown) that receives a plug (not shown) of the connector 456 or defines a plug (not shown) that is configured to be received within a socket (not shown) of the connector 456.

In the illustrated embodiment, the contacts 464 are pogo pins, however other types of contacts are possible in alternative embodiments, such as, but not limited to, spring fingers, contact pads, and/or the like. The contacts 464 include mating interfaces 476 that are exposed along the mating interface surface 468 of the housing 462 and that mate with the corresponding contacts 474 of the connector 456. The mating interfaces 476 of the contacts 464 define at least a portion of the mating interface 458 of the connector 454. The contacts 464 define a separable mating interface 458 for the connector 456. For example, the contacts 464 may be readily and easily mated to, and unmated from, the contacts 474 as the upper receiver 114 is moved between the open and closed positions. Although five are shown, the connector 454 may include any number of contacts 464.

In the illustrated embodiment, the mating interfaces 472 of the contacts 464 extend outward from the mating interface surface 468. In other embodiments, at least a portion of one or more of the mating interfaces 476 is aligned with the mating interface surface 468, and/or at least a portion of one or more of the mating interfaces 476 is recessed below the mating interface surface 468. Although shown as being arranged in a single row, the mating interfaces 476 of the contacts 464 may be arranged in any configuration, pattern, arrangement, and/or the like, such as, but not limited to, a rectangular pattern having any number of rows and/or columns, a circular or otherwise curved pattern, and/or the like.

The connector 456 may be mounted to the extension 522 of the rear attachment member 126 using any structure, means, fastener, and/or the like, such as, but not limited to, one or more threaded fasteners, an adhesive, a dovetail arrangement, and/or the like. For example, in the illustrated embodiment, the housing 462 includes mounting ears 478 that receive corresponding threaded fasteners 482 therethrough. The threaded fasteners 482 threadably connect to the extension 522 via nuts (not shown) and/or threaded openings (not shown) of the extension 522. In addition or alternative to the mounting ears 478 and/or the threaded fasteners 482, and for example, an adhesive may extend between the housing 462 and the extension 522.

The communication connector system 406 includes one or more communication conductors (not shown) that electrically, optically, inductively and/or otherwise connect the contacts 464 of the connector 454 to the electronics 103 (FIGS. 1 and 2) associated with the rail 102 (FIGS. 1, 2, and 4). Each communication conductor may be any type of optical, electrical, inductive, or other type of conductor, such as, but not limited to, a wire, a fiber, a cable, and/or the like. Other examples of communication conductors include, but are not limited to, a circuit board, a flex circuit, a conductor of a circuit board, a conductor of a flex circuit, a conductor of a cable, and/or the like. The system 406 may include any number of communication conductors for communicatively connecting the connector 454 to the electronics 103.

Referring again to FIG. 7, the upper receiver 114 is shown in the open position. The upper receiver 114 is pivoted towards the lower receiver 116, such as in the direction of arrow C, as the upper receiver 114 is moved to the closed position. The extension 522 of the rear attachment member 126 of the upper receiver 114 is received within the cavity 526 of the lower receiver 116 until the rear takedown pin opening 134 of the upper receiver 114 is aligned with the rear takedown pin opening 138 of the lower receiver 116. As the upper receiver 114 is moved to the closed position, the connector 454 of the upper receiver 114 is moved into engagement with the connector 456 of the lower receiver within the cavity 526. The contacts 464 (FIG. 9) of the connector 454 engage the contacts 474 (FIG. 8) of the connector 456 within the cavity 526. In other words, the connectors 454 and 456 mate within the cavity 526.

A separable interface is defined between the contacts 464 and the contacts 474. The contacts 464 automatically engage the contacts 474 when the upper receiver 114 is rotated to the closed position. No separate action is required by the user. For example, the user does not need to separately plug or mate the connectors 454 and 456 together. No guidance is required by the user for guiding the connector 454 to the connector 456 as the upper receiver 114 is moved to the closed position. Having the connector 454 mounted to rear attachment member 126 of the upper receiver 114 having the connector 556 held within the cavity 526 at or adjacent the rear attachment member 130 of the lower receiver 116 ensures that the connectors 454 and 456 are aligned so that the connector 454 automatically mates with the connector 456 as the upper receiver 114 is moved to the closed position. When the rear takedown pin 122 (FIGS. 1 and 2) is positioned within the takedown pin openings 134 and 138, the connector 454 is locked in a mated position with the connector 456. The connector 454 cannot be unmated from the connector 456 without removing the rear takedown pin 122.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A communication connector system for a weapon, the weapon having an upper receiver with electronics associated with the upper receiver, the weapon having a base that includes a lower receiver, the base housing electronics, the upper receiver being coupled to the lower receiver in a closed position and at least partially de-coupled from the lower receiver in an open position, the communication connector system comprising:

an upper connector mounted directly only to an exterior side surface of the upper receiver of the weapon, the upper connector communicatively connected to the electronics associated with the upper receiver, the upper connector having a mating interface; and a lower connector communicatively connected to the electronics in the base of the weapon, the lower connector mounted directly only to an exterior side surface of the lower receiver of the weapon, the lower connector having a mating interface that is mated with the mating interface of the upper connector when the upper receiver is in the closed position, wherein the mating interfaces of the upper and lower connectors are physically separable from one another.

2. The communication connector system of claim 1, wherein the upper and lower receivers of the weapon engage each other at an interface when the upper receiver is in the closed position, the mating interfaces of the upper and lower connectors mating with one another at the interface between the upper and lower receivers.

3. The communication connector system of claim 1, wherein the upper connector is mounted directly to the exterior side surface of the upper receiver of the weapon using at least one of a threaded fastener or an adhesive.

4. The communication connector system of claim 1, wherein the lower connector is mounted directly to the exterior side surface of the lower receiver of the weapon using at least one of a threaded fastener or an adhesive.

5. The communication connector system of claim 1, wherein the upper connector comprises a housing and a contact held by the housing, the upper connector mounted directly to the exterior side surface of the upper receiver such that the housing is in direct physical contact with the exterior side surface.

6. The communication connector system of claim 1, wherein the lower connector comprises a housing and a contact held by the housing, the lower connector mounted directly to the exterior side surface of the lower receiver such that the housing is in direct physical contact with the exterior side surface.

7. The communication connector system of claim 1, wherein the upper receiver of the weapon includes a channel that extends into the exterior side surface of the upper receiver, the communications connector system further comprising a communication conductor that extends within the channel, the communication conductor communicatively connecting the upper connector to the electronics associated with the upper receiver.

8. The communication connector system of claim 1, wherein the lower receiver of the weapon includes a channel that extends into the exterior side surface of the lower receiver, the communications connector system further comprising a communication conductor that extends within the channel, the communication conductor communicatively connecting the lower connector to the electronics in the base of the weapon.

9. The communication connector system of claim 1, wherein the upper receiver of the weapon includes an upper interface surface and the lower receiver includes a lower interface surface, the upper and lower interface surfaces engaging each other at an interface when the upper receiver is in the closed position, the exterior side surface of the upper receiver intersecting the upper interface surface and extending at a non-parallel angle relative to the upper interface surface, the exterior side surface of the lower receiver intersecting the lower interface surface and extending at a non-parallel angle relative to the lower interface surface.

10. The communication connector system of claim 1, wherein the base of the weapon further includes at least one of a hand grip that extends from the lower receiver or a butt stock that extends from the lower receiver.

11. A weapon comprising:

a base having a lower receiver, the base housing electronics therein, the lower receiver comprising an exterior side surface and a channel extending into the exterior side surface;

an upper receiver comprising an exterior side surface and a channel extending through and into the exterior side surface, the weapon comprising electronics associated with the upper receiver, the upper receiver coupled to the lower receiver in a closed position and at least partially de-coupled from the lower receiver in an open position; and a communication connector system comprising:

an upper connector mounted to the upper receiver, the upper connector having a mating interface;

an upper communications conductor extending within the channel of the upper receiver, the upper communications conductor communicatively connecting the upper connector to the electronics associated with the upper receiver;

a lower connector mounted to the lower receiver, the lower connector having a mating interface that is mated with the mating interface of the upper connector when the upper receiver is in the closed position; and a lower communications conductor extending within the channel of the lower receiver, the lower communications conductor communicatively connecting the lower connector to the electronics in the base.

12. The weapon of claim 11, wherein the upper receiver is rotatably coupled to the lower receiver such that the upper receiver rotates between the open and closed position.

13. The weapon of claim 11, wherein at least one of the upper communications conductor or the lower communications conductor comprises at least one of a wire, a cable, a circuit board, a fiber, or a flex circuit.

14. The weapon of claim 11, wherein at least one of:

the upper connector is mounted directly to the exterior side surface of the upper receiver; or the lower connector is mounted directly to the exterior side surface of the lower receiver.

15. The weapon of claim 11, wherein the upper receiver includes an upper interface surface and the lower receiver includes a lower interface surface, the upper and lower interface surfaces engaging each other at an interface when the upper receiver is in the closed position, the exterior side surface of the lower receiver intersecting the lower interface surface and extending at a non-parallel angle relative to the lower interface surface, the exterior side surface of the upper receiver intersecting the upper interface surface and extending at a non-parallel angle relative to the upper interface surface.

16. A weapon comprising:

a base having a lower receiver, the base housing electronics therein, the lower receiver comprising a lower pin opening and a cavity;

an upper receiver having an attachment member that includes an upper pin opening, the upper receiver having electronics associated therewith, the upper receiver coupled to the lower receiver in a closed position and at least partially de-coupled from the lower receiver in an open position, the attachment member of the upper receiver being received within the cavity of the lower receiver when the upper receiver is in the closed position such that the upper and lower pin openings are aligned;

a takedown pin configured to be received within the upper and lower pin openings to hold the upper receiver in the closed position; and a communication connector system comprising:

an upper connector mounted to the attachment member of the upper receiver, the upper connector being communicatively connected to the electronics associated with the upper receiver, the upper connector having a mating interface; and a lower connector held within the cavity of the lower receiver, the lower connector being communicatively connected to the electronics in the base, the lower connector having a mating interface, the mating interfaces of the upper and lower connectors being mated together within the cavity of the lower receiver when the upper receiver is in the closed position.

17. The weapon of claim 16, wherein the attachment member of the upper receiver extends outwardly from an interface surface of the upper receiver to an end, the upper connector being mounted to the attachment member such that the upper connector extends outwardly from the end of the attachment member.

18. The weapon of claim 16, wherein the upper connector is mounted to attachment member of the upper receiver using at least one of a threaded fastener or an adhesive.

19. The weapon of claim 16, wherein the lower receiver includes a lower interface surface that faces generally the upper receiver, the lower interface surface being engaged with the upper receiver when the upper receiver is in the closed position, the cavity of the lower receiver extending into the lower interface surface.

20. The weapon of claim 16, wherein the upper receiver is rotatably coupled to the lower receiver such that the upper receiver rotates between the open and closed position.

* * * * *